United States Patent [19]

Deslauriers

[11] Patent Number: 4,467,948

[45] Date of Patent: Aug. 28, 1984

[54] WASTE STRIPPER

[76] Inventor: Clovis F. Deslauriers, 25-52 Borough Pl., Woodside, N.Y. 11377

[21] Appl. No.: 403,059

[22] Filed: Jul. 29, 1982

[51] Int. Cl.[3] ..... B26F 3/00; B65H 35/10

[52] U.S. Cl. ..... 225/97; 83/103; 225/99

[58] Field of Search ..... 83/923, 422, 103; 225/3, 97, 98, 99

[56] References Cited

U.S. PATENT DOCUMENTS

| | | | |
|---|---|---|---|
| 2,171,769 | 9/1939 | Stolar et al. | 225/97 |
| 2,753,936 | 7/1956 | MacChesney | 225/99 |
| 3,055,567 | 9/1962 | Sayford, Jr. | 225/99 |
| 3,128,660 | 4/1964 | Gaubert | 83/422 |
| 3,165,433 | 1/1965 | Markowicz | 225/99 |
| 3,182,875 | 5/1965 | Fleming | 225/99 |
| 3,807,610 | 4/1974 | Mueller, Jr. | 225/99 |
| 3,889,863 | 6/1975 | Deslauriers | 225/99 |
| 4,033,240 | 7/1977 | Deslauriers | 225/99 |
| 4,096,981 | 6/1978 | Martorano | 225/99 |
| 4,109,842 | 8/1978 | Aquilla | 225/98 |

*Primary Examiner*—Frank T. Yost
*Assistant Examiner*—Hien H. Phan
*Attorney, Agent, or Firm*—Karl L. Spivak

[57] ABSTRACT

A waste stripping machine for automatically removing waste from previously die-cut blanks is disclosed. The machine incorporates a feed conveyor to deliver the blanks individually to a stripping section in planar alignment. The stripping section includes a pair of transversely spaced waste strippers which are spaced apart an adjustable distance that is equal to the width of the blank. A rack and pinion traversing mechanism is included to easily move one waste stripper relative to the other for blank size adjustment purposes. Each waste stripper is fabricated with a driving belt and two driven belts whereby one driven belt defines a planar waste engaging area with the driving belt and the other driven belt defines a circular waste engaging area with the driving belt. The machine is powered by a single motor which functions the feed conveyor and the waste strippers in synchronism to deliver the stripped blank to discharge rollers, which rollers are also rotated in synchronism. The lateral edges of the waste portions of the blanks are engaged in the planar waste engaging area and are driven into the circular waste engaging area wherein the waste is driven from the planar path of the blank travel to positively separate the waste from the usable portion of the blank.

18 Claims, 6 Drawing Figures

WASTE STRIPPER

BACKGROUND OF THE INVENTION

This invention relates generally to the field of waste stripping and more particularly is directed to an apparatus and a method for automatically stripping waste material from previously die cut blanks.

In the cardboard box and corrugated carton industry, it is the usual practice to form sheet materials such as cardboard and corrugated board into rectangular blanks and then to design a package configuration in the blank. By utilizing conventional die cutting apparatus, the usable portions of the blank are defined from the waste portions. The positive separation of the waste material to be trimmed from the usable portions of the blank has continuously presented both practical and economic problems in the industry.

One of the older and still used techniques that is commonly employed throughout the industry is the practice of stacking a plurality of previously die cut sheets into piles wherein all of the blanks are placed in registry one above the other. Then, by utilizing conventional hand tools, the waste materials can be manually removed or stripped from the plurality of the stacked sheets or blanks at the same time. It is usual to accomplish this waste trimming function in a relatively slow operation by engaging one or more employees to physically separate the waste from the remainder of the blank. The workers usually employ hammers or other types of impact applying tools and one or more employees per shift are required for this duty. The end result of these old practices is to accomplish the desired waste stripping operations, but in a slow and costly procedure.

In more modern approaches to the same problem, other prior workers have sought to utilize automatic machinery to mechanically strip the waste from the remainder of the blank. Such prior art machines have employed vibrating mechanisms, punching mechanisms and in one of the applicant's own earlier designs, a rotary stripping wheel. The stripping wheel type of waste removal apparatus is fully disclosed in the applicant's prior U.S. Pat. No. 3,889,863.

While the prior art methods of waste removal are generally effective in removing or trimming the waste from the usable portion of the blank, such prior art methods and machines have not found one hundred percent acceptance in the industry. This lack of acceptance could be due to the economic disadvantages inherent in the system, the fact that in certain of the mechanical designs peak efficiency could not be achieved or because such prior art machines could only be adjusted after elaborate set-up procedures. Such complicated set-up required skilled personnel and extended periods of down time every time the blank size was changed, thereby detracting from the other advantages that may have been present in the operating concept of the machine.

SUMMARY OF THE INVENTION

The present invention relates generally to the field of trimming waste from previously die cut blanks, and more particularly, is directed to an improved waste stripper that is substantially universally adaptable for handling blanks of various sizes without complicated set-up procedures.

The waste stripper of the present invention comprises a feed conveyor which is positioned to receive previously die cut sheets, either corrugated board or cardboard, one at a time. The feed conveyor functions to propel the die cut blanks individually toward a stripping section wherein a novel stripping means, which is designed for continuous, automatic operation, functions automatically to separate the waste as the blanks are carried through the stripping section.

The stripping section includes a pair of laterally spaced, positive acting, waste remover or stripping means, which means are transversely spaced and positioned to engage the lateral edge portions of each die cut blank for waste removal purposes as the blank is fed through the stripping section. Tranversely spaced supports are positioned in the stripping section to support the blanks in planar alignment as the blanks are propelled through the stripping section. The waste remover means continuously engage lateral portions of the waste to be trimmed and function to drive the waste downwardly, out of the horizontal, planar path of travel of the blank as it is carried through the apparatus.

The trim stripper of the present invention further includes discharge rollers which are vertically spaced to form a nip in alignment with the planar path of travel and which are simultaneously driven to discharge each treated blank in fully trimmed condition, ready for the next operation in the package forming process. In a preferred arrangement, the die cut blanks can be stacked upon a pallet which may include an elevating mechanism to facilitate easy transportation of the completed or stripped blanks to the next station in the carton forming operation. The waste stripper of the present invention can include a waste conveyor which is positioned to receive the trimmed waste in known manner to convey the scrap to a suitable place of disposal. In the preferred embodiment, the operation of the feed conveyor, the laterally spaced stripping means and the discharge rollers are all synchronized for cooperative movement of the blanks through the apparatus. The waste conveyor need not be so synchronized.

Lateral adjustment means are included to permit one of the waste remover or stripping means to be moved relative to the other to quickly and easily vary the lateral spacing between the pair of edge positioned waste remover means. Accordingly, by moving one waste remover means upon functioning the lateral adjustment means, the trim stripper can be quickly and easily set up to engage the lateral edges of each blank and thereby accommodate different runs of various sized, previously die cut cardboard or corrugated blanks.

It is therefore an object of the present invention to provide an improved waste stripper of the type set forth.

It is another object of the present invention to provide a novel waste stripper comprising a conveyor positioned to receive individually a plurality of previously die cut blanks, at least one laterally mounted waste remover or stripping means positioned to engage an edge waste portion of each blank as it is delivered by the conveyor, the waste remover means including a plurality of driven belts which are arranged to continuously engage the waste therebetween and to drive the waste from the plane of blank travel, whereby the blank can continue along its planar path of travel while the waste is driven away from the plane to thus effect positive separation and waste removal.

It is another object of the present invention to provide a novel trim stripper comprising a feed conveyor adapted to receive previously die cut blanks and to convey the blanks individually in planar alignment to a stripping section, a pair of laterally spaced waste remover means comprising the stripping section, each of which is adapted to engage and separate edge portions of the waste to be trimmed, and lateral adjustment means adapted to transversely move at least one of the waste remover means whereby the lateral spacing between the pair of waste remover means may be easily adjusted to accommodate the width of the blank being stripped.

It is another object of the present invention to provide a waste trim stripper comprising input conveyor means to individually receive previously die cut blanks and to convey the blanks toward a stripping section, a pair of laterally positioned waste remover means aligned to engage edge portions of each die cut blank as the blank is delivered to the stripping section by the input conveyor, the waste remover means including belts adapted to engage edge portions of the trim continuously therebetween and not to release the edge portions until the waste is separated from the blank, and means to discharge the trimmed blank from the waste stripper, the means to discharge being adapted to function in the same horizontal plane as the input conveyor.

It is another object of the present invention to provide a novel trim stripper that is rugged in construction, simple in design and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
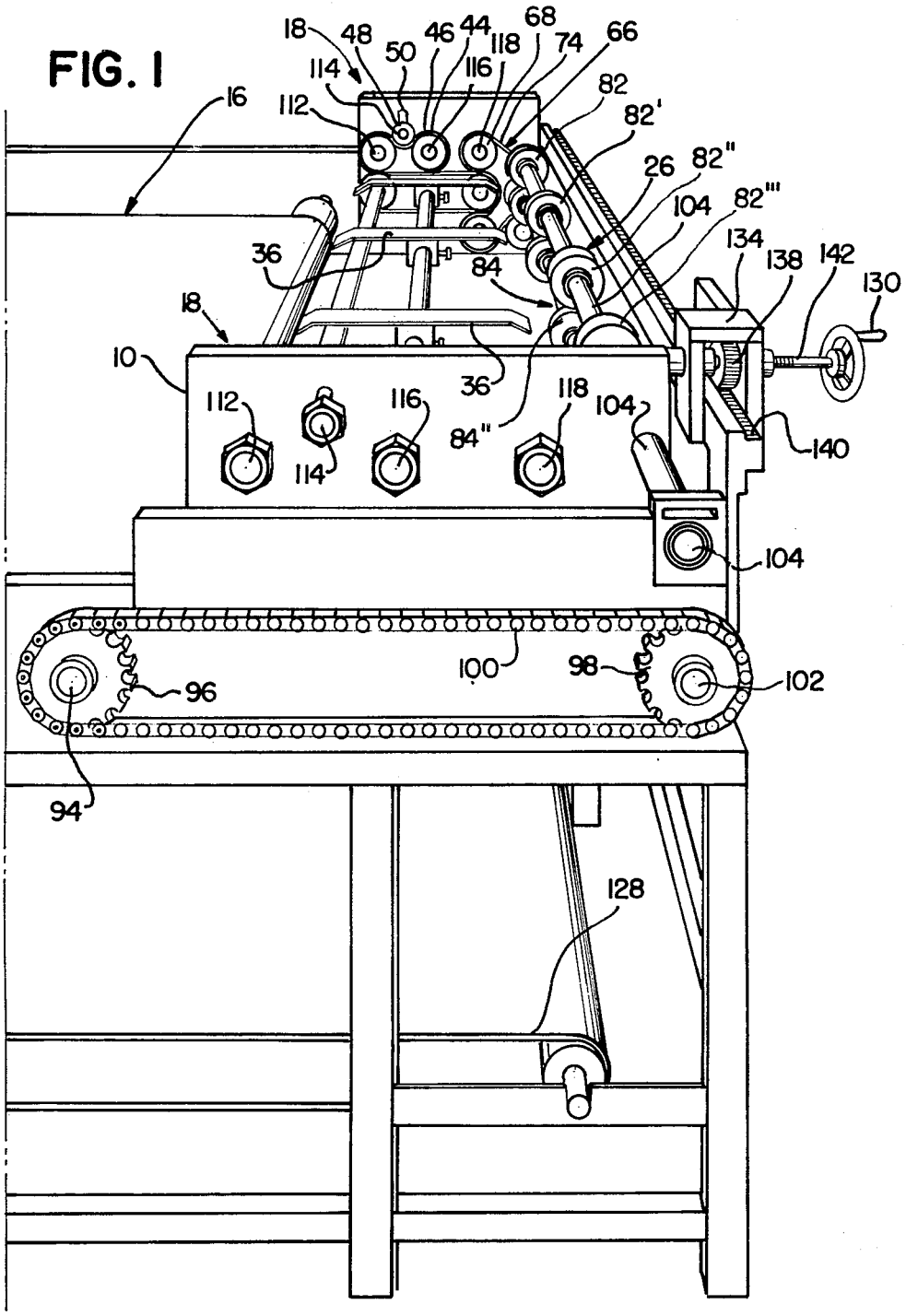
FIG. 1 is a partial, side perspective view of the waste stripper in accordance with the present invention.

Although specific terms are used in the following description for the sake of clarity, these terms are intended to refer only to the particular structure of the invention selected for illustration in the drawings, and are not intended to define or limit the scope of the invention.

Figure 2:
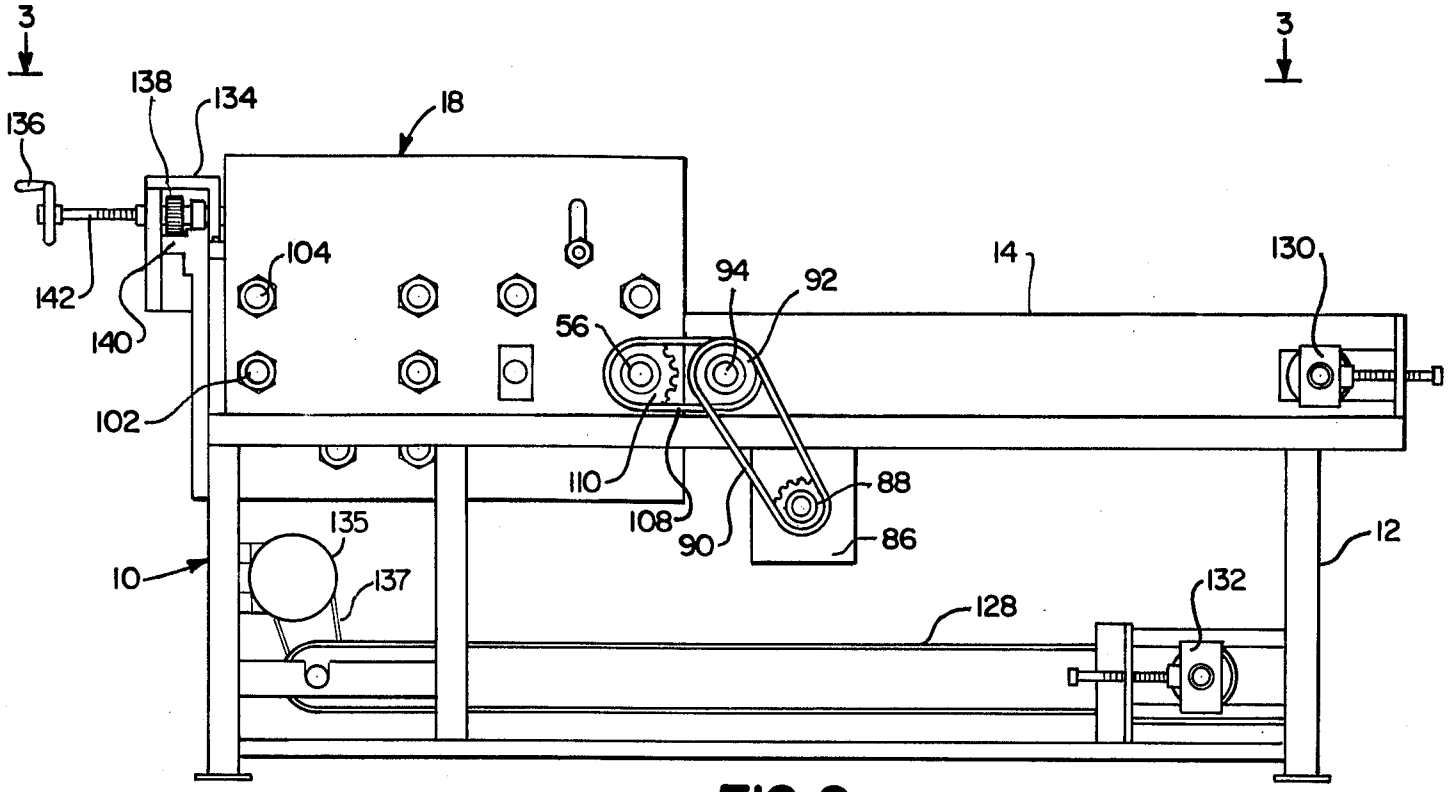
FIG. 2 is a right side elevational view of the waste stripper illustrated in FIG. 1.
Figure 3:
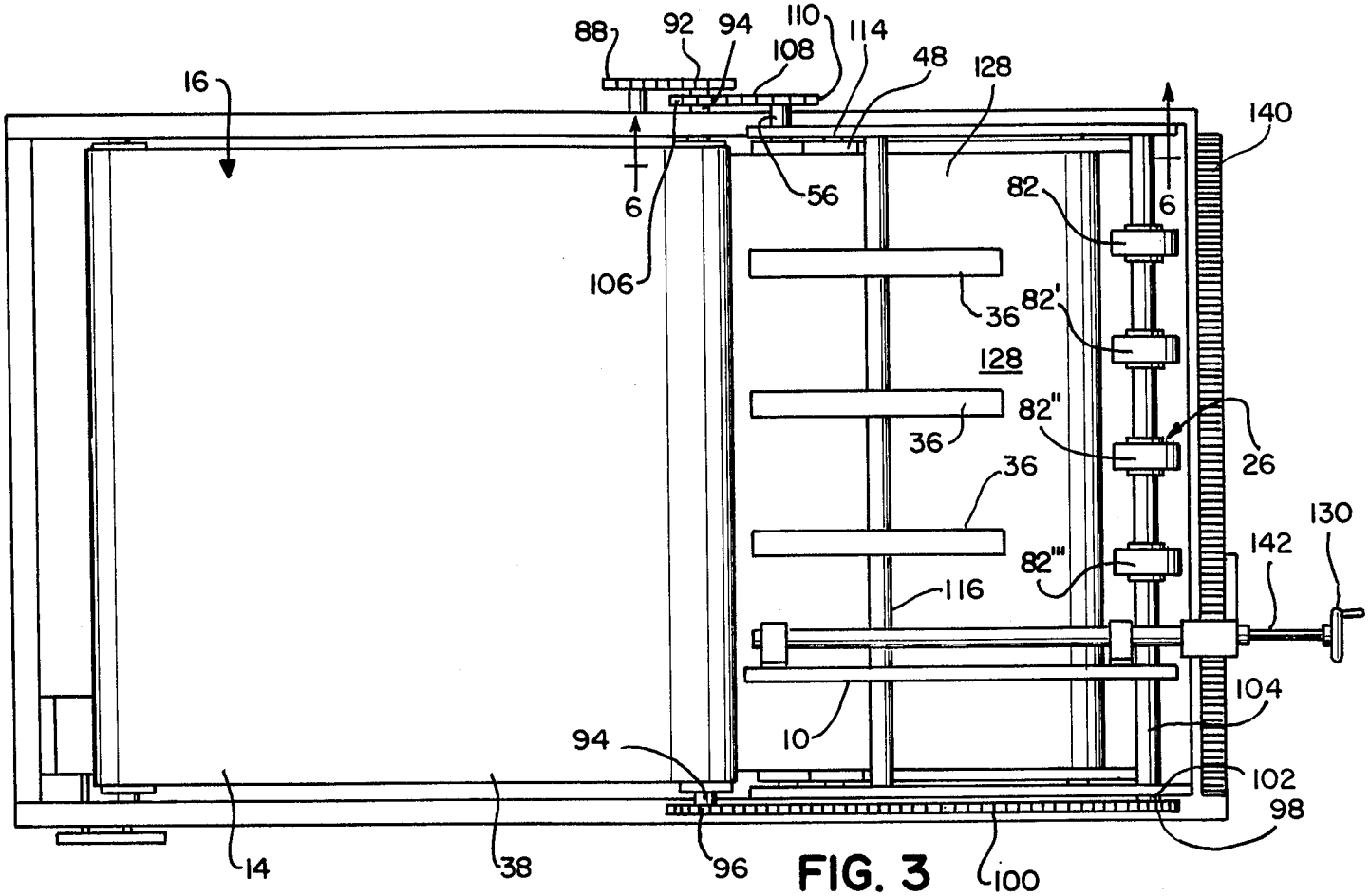
FIG. 3 is a top plan view looking from line 3—3 on FIG. 2.

Referring now to the drawings, there is shown in FIGS. 1, 2 and 3 a stripping machine generally designated 10 which comprises a sturdy frame 12 of size and dimensions to support the operating components as hereinafter more fully set forth. The frame 12 defines an input end 14 wherein previously die cut blanks are deposited in known manner individually for processing in the stripping machine.

A feed conveyor 16 is supported with its upper run 38 carried in a generally horizntal plane for moving the die cut blanks through the apparatus in planar alignment. The feed conveyor 16 individually carries the die cut blanks forwardly through the stripping machine and delivers the blanks one at a time to the stripping section 18 for removal of the die cut waste in the manner hereinafter more fully set forth. After processing in the stripping section 18 for removal of the waste or scrap 22 (FIG. 6), the usable portion 24 of each blank is delivered to the discharge section 26 in planar alignment. The vertically aligned rollers 82, 82', 82'', 82''' and 84, 84', 84'', 84''' comprising the discharge section 26 deliver each trimmed blank 24 forwardly of the frame 12 for further processing, such as printing (not shown), folding (not shown) and gluing (not shown).

Figure 6:
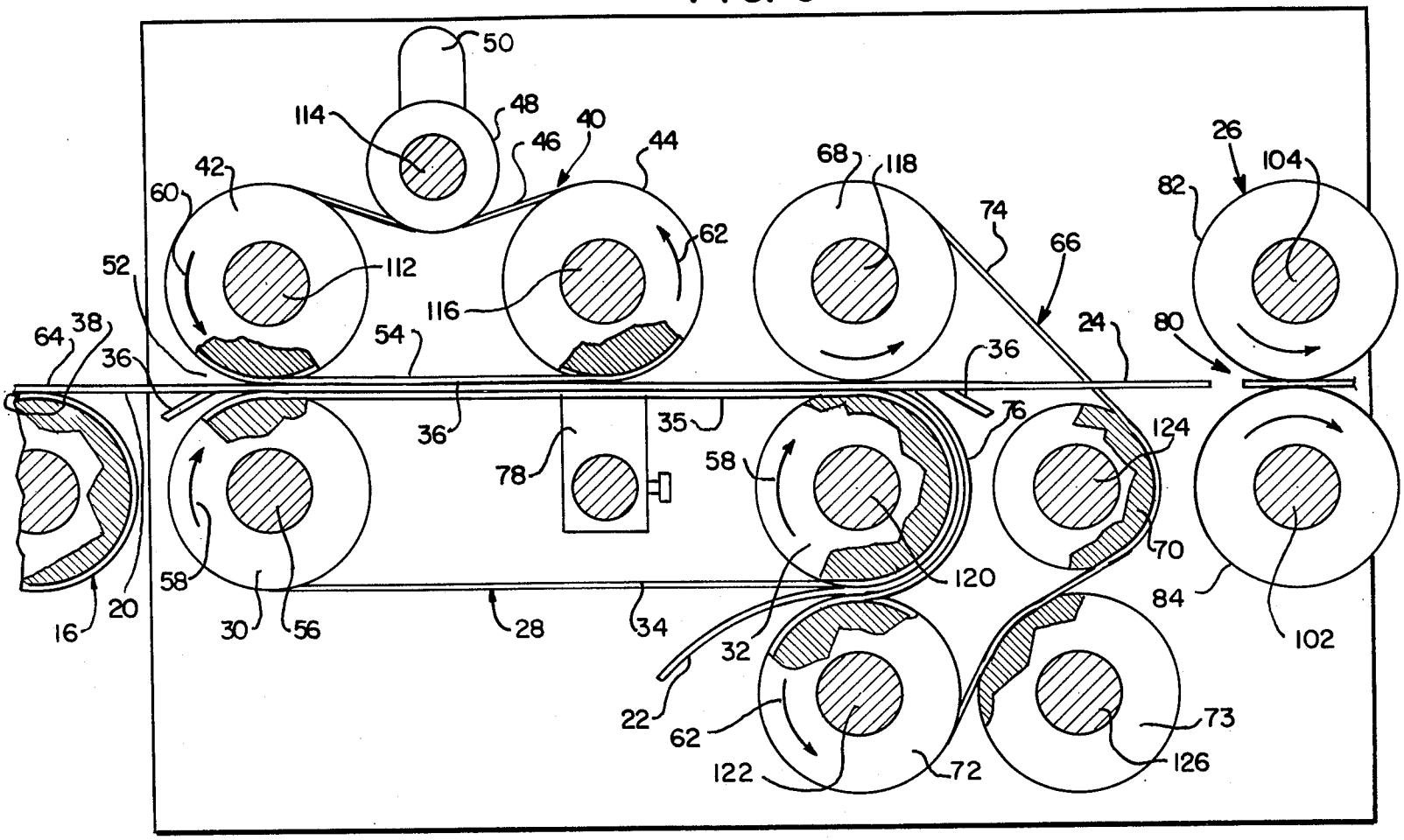
FIG. 6 is an enlarged, cross-sectional view taken along line 6—6 on FIG. 3, looking in the direction of the arrows, and partially broken away to expose interior construction details.

As best seen in FIG. 6, the stripping section 18 comprises generally a driving belt system 28 which includes a driving pulley 30 and a belt 34 trained about the pulley 30, which pulley rotates in synchronism with the remaining operating portions of the machine, as hereinafter more fully set forth. The upper run 35 of the belt 34 is maintained in planar alignment with the upper run 38 of the feed conveyor 16 by the position of the driven pulley 32. Accordingly, as the die cut blanks 20 are delivered to the stripping section 18 by the feed conveyor 16, the blanks will pass through the stripping section in planar alignment whereby the usable portions 24 of the blanks 20 will travel in planar alignment throughout. The waste 22 will be engaged between cooperating belts 34, 46 and will be stripped or removed from the blank in the stripping section 18. The cooperating belt 34, 46 positively engage transverse edge portions of the waste 22 and drive the waste downwardly, out of the planar path of blank travel, thereby causing positive waste separation.

A driven belt system 40 comprises a pair of horizontally aligned driven pulleys 42, 44 and a belt 46 which is arranged for rotation about the pulleys 42, 44. A tensioning roller 48 is vertically adjustable within the adjustment slot 50 to facilitate easy tensioning adjustment of the belt 46. The driven pulley 42 of the system 40 vertically registers above the driving pulley 30 of the driving belt system 28 to form a nip 52 therebetween to receive each die cut blank 20 from the feed conveyor 16 and to urge the blank forwardly through the stripping section 18 during the waste removal process. As illustrated in FIG. 6, the lower run 54 of the belt 46 is in frictional overall engagement with the upper run 35 of the driving belt 34 whereby power input at the shaft 56 of the driving pulley 30 causes the pulley 30 to rotate in the direction of the arrow 58.

The frictional engagement of the driven belt 46 with the driving belt 34 causes simultaneous rotation of the belt 46, which belt in turn rotates its pulleys 42, 44 in the directions indicated by the arrows 60, 62. Preferably, one stripping section 18 is provided along each transverse side of the machine 10 to engage each lateral side of a blank 20 as the blank passes through the stripping section. The frictional engagement between the lower run 54 of the belt 46 and the upper run 35 of the belt 34 function to secure or clinch each lateral edge of each blank as the blank is carried through the stripping section. Accordingly, when the stripping system functions in the manner hereinafter described, both lateral waste portions 22 of the blank which are to be trimmed will be secured between the belts 34, 46 and will be positively and continuously driven out of the horizontal plane of travel 64 which is defined by the upper run 38 of the feed conveyor 16 and the upper run 35 of the driving belt 34.

Downstream from the driven belt system 40 is positioned the stripping belt system 66 which comprises generally a pair of vertically aligned stripping pulleys 68, 72, which pulleys are in vertical registry with the pulley 32 of the driving belt system 28. The pulleys 68, 72 tangentially contact the pulley 32 for waste stripping as hereinafter more fully set forth. A stripping belt 74 rotates about the pulleys 68, 72 and the forward pulley 70 of the stripping belt system 66 and the driven roller 32 of the driving belt system 28. A tensioning roller 73 bears against a portion of the belt 74 for belt tensioning purposes in well known manner. It is noteworthy that the stripping belt 74 makes a reverse bend about the driven pulley 32 and that the stripping belt 74 is in frictional engagement with the driving belt 34 through the distance that the belt 74 travels about the driven roller 32. The frictional belt engagement about the pulley 32 causes simultaneous, synchronized rotation of the belts 34, 74.

It is the essence of this invention that the waste 22 to be trimmed from the blank 20 is positively engaged and driven out of the plane 64 of blank travel at the frictional engagement area 76 between the belts 34, 74 as the belts travel about the driven pulley 32 in unison. During the waste removal operation, a plurality of transversely spaced, longitudinally extending supports 36 function to carry the usable portion 24 of each die cut blank 20 through the stripping section 18 in the plae 64 of blank travel. The trimmed waste 22 is driven out of the planar path of travel by the frictional engagement area 76 between the belts 34, 74. As the waste is removed by the interaction of the belts 34, 74 about the driven pulley 32, the usable portion 24 of the die cut blank 20 will be propelled forwardly in planar alignment by the frictional engagement of the belts 34, 46. When the leading edge of the trimmed, usable portion 24 reaches the nip 80 which is defined between the respective pairs of upper and lower discharge rollers 82, 84, 82', 84', 82'', 84'', 82''', 84''', the rollers will function to discharge the trimmed blank 24. One of each pair of rollers, for example the lower discharge rollers 84, 84', 84'', 84''' is powered for trimmed blank discharge in the manner hereinafter more fully set forth.

Figure 4:
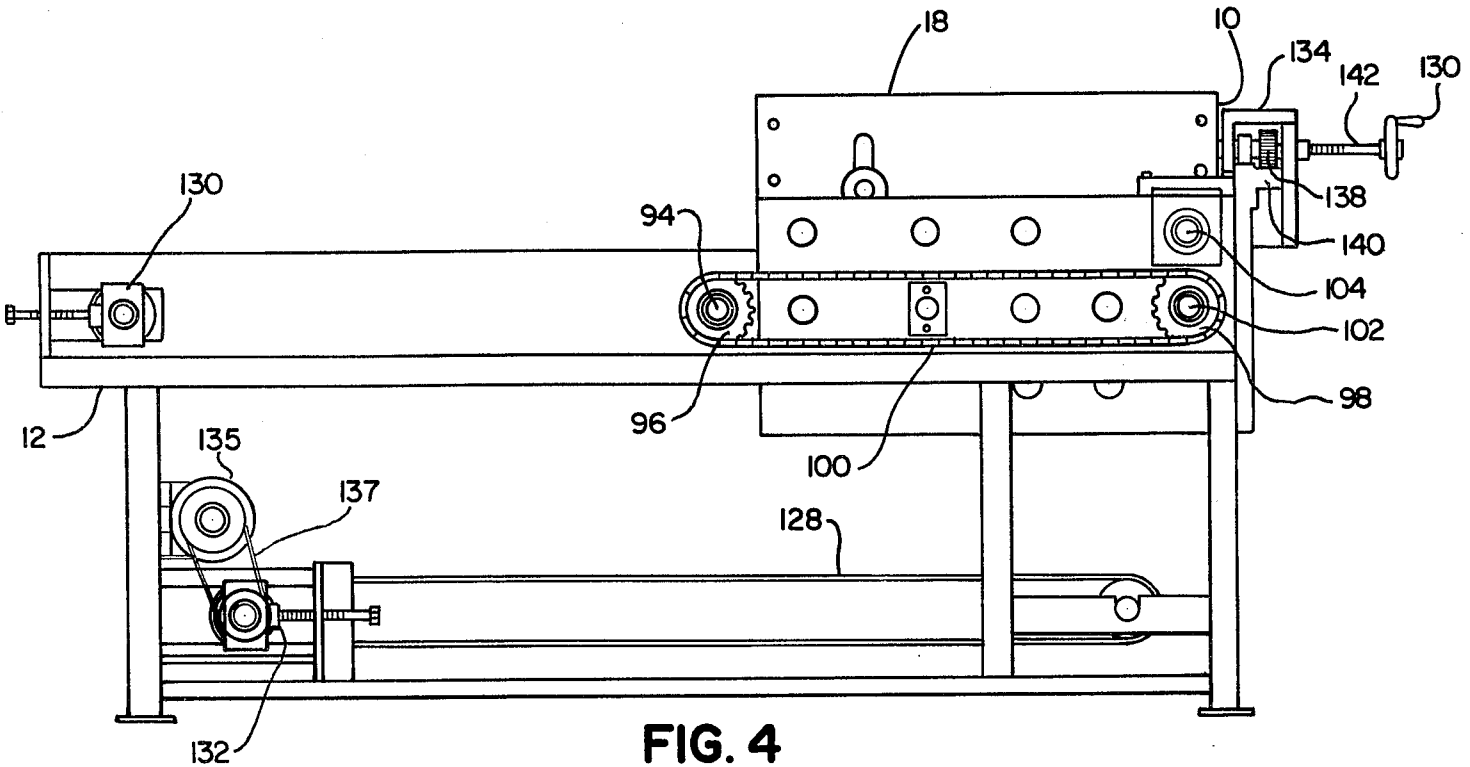
FIG. 4 is a left side elevational view of the waste stripper illustrated in FIG. 1.

Referring to FIGS. 2, 3 and 4, a preferred drive mechanism can now be described in detail. A motor 86 mounts in secure manner upon the frame 12 and is suitably powered to rotatively drive its driving sprocket 88 and to rotate the drive chain 90 in conventional manner. The chain 90 rotates the conveyor sprocket 92 and its affixed shaft 94 for function of the feed conveyor 16. On the opposite side of the frame 12, the shaft 94 rotates a drive sprocket 96, which sprocket in turn simultaneously rotates the discharge roller drive sprocket 98 through the interconnecting chain 100. It will be noted that the drive mechanism functions in synchronism throughout the feed conveyor, the stripping section and the discharge rollers. The discharge roller drive sprocket 98 is pinned or otherwise conventionally affixed to the shaft 102, which shaft in turn rotates all of the plurality of lower discharge rollers 84, 84', 84'', 84'''. As hereinabove set forth, the plurality of spaced, upper discharge rollers 82, 82', 82'', 82''' tangentially respectively contact one of the plurality of lower rollers and are thereby frictionally driven. Rotation of the upper discharge rollers 82, 82', 82'', 82''' simultaneously rotates the upper discharge roller shaft 104 whereby all of the upper rollers will rotate in unison.

A drive sprocket 106 (FIG. 3) is pinned or otherwise secured upon the shaft 94 in common with the feed conveyor sprocket 92 to rotate the stripping section chain 108. The chain 108 in turn rotates the driven sprocket 110 to thereby rotate the driving pulley shaft or power shaft 56. As above set forth, rotation of the power shaft 56 causes rotation of the driving pulley 30 and the driven pulley 32. The frictional engagement of the various belts as hereinbefore described causes simultaneous rotation in synchronism of all of the pulleys and their respective shafts 42, 112; 48, 114; 44, 116; 68, 118; 32, 120; 72, 122; 70, 124; and 73, 126.

It is a feature of the present invention to provide a pair of identical, laterally spaced stripping sections 18, 18' whereby the frictional engagement areas 76 functioning along the transverse sides of each die cut blank 20, cooperate and function in unison to positively turn the lateral waste edges of each die cut blank 20 downwardly out of the plane 64 of blank travel to thereby positively and cleanly strip the waste portions 22 from the usable portions 24 of each previously die cut blank 20.

If desired, the frame 12 can also be equipped to carry a waste conveyor 128 below the stripping section 18 to move the trimmed waste 22 from the stripping machine 10. Accordingly, when the waste is positively separated upon engagement in the frictional engagement area 76 of each laterally spaced stripping section 18, the trimmed waste will be directed downwardly to drop upon the waste conveyor 128 for removal rearwardly. The conveyor 128 can be conventionally powered by a separate motor 135 and drive 137 in known manner. There is no need to synchronize the operation of the waste conveyor 128 with the feed conveyor 16 inasmuch as the waste 22 has already been separated from the remainder of the blank by the time it drops upon the waste conveyor 128. As best seen in FIGS. 2 and 4, both the feed conveyor 16 and the waste conveyor 128 may be provided with tension adjusting mechanisms 130, 132 in well known manner.

Figure 5:
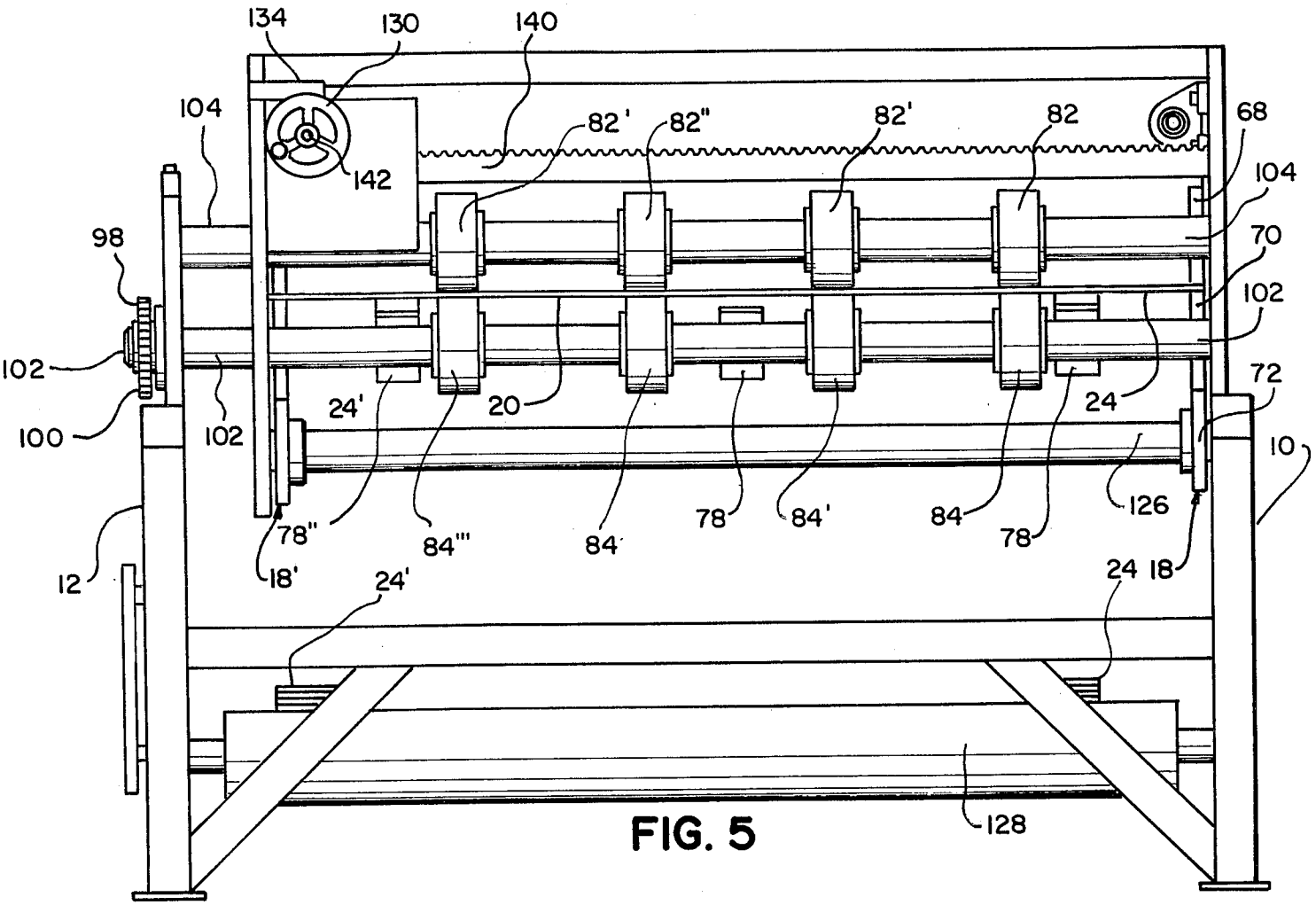
FIG. 5 is a front perspective view of the waste stripper of FIG. 1.

In order to reduce set up time to an absolute minimum and to readily adapt the stripping machine 10 to strip blanks 20 of varying widths, one of the laterally placed stripping sections 18, for example the left stripping section 18' as viewed in FIG. 5, is provided with an adjusting carriage 134 upon which the left stripping section 18' is carried to permit easy adjustment to the spacing between the laterally positioned stripping sections 18, 18'. The adjusting carriage 134 comprises generally a hand wheel 136 which functions a pinion gear 138 to move along a transversely extending rack 140. Accordingly, by rotating the hand wheel 136 to turn the shaft 142 and the attached pinion 138, the adjusting carriage 134 will traverse laterally along the rack 140 to thereby position the stripping sections 18, 18' a desired transverse distance apart. The transverse spacing between the stripping sections 18, 18' should be exactly equal to the width required so that the transverse edges of each die cut blank 20 will be engaged between the frictionally contacting areas of the various belts 34, 46 and 74 which are rotatively carried in each stripping section 18, 18'. This easy width adjustment can be readily accomplished to swiftly adapt the stripping machine 10 to accommodate die cut blanks of various sizes without elaborate set up or extended periods of down time.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A waste stripper for removing automatically the waste from the usable portions of previously die-cut blanks comprising a frame having lateral sides, an input end and a discharge end;

a feed conveyor supported on the frame and being adapted to carry the die-cut blanks from the input end toward the discharge end;

a stripping section supported on the frame near the discharge end and being positioned to receive the die-cut blanks from the feed conveyor, the stripping section comprising support means to support the blank usable portions in a plane, and stripping belt means to engage edge portions of the waste and to carry the engaged edge portions away from the plane;

discharge means to receive the blank usable portions from the support means and to discharge the usable portions at the discharge end; and power means to function the feed conveyor, the stripping belt means and the discharge means in synchronism;

the stripping belt means comprising a plurality of three stripping belts, the first of said belts being rotatively driven by the power means, the second of said belts being in frictional engagement with and being rotatively driven by the first belt through a first frictional engagement area, the edge portions of the waste being engaged in the first frictional engagement area.

2. The waste stripper of claim 1 wherein the power means comprises a motor, a feed conveyor shaft, a stripping section shaft, a discharge means shaft and means interconnecting the motor and the said shafts to rotate all of the said shafts in synchronism.

3. The waste stripper of claim 1 wherein the stripping section comprises a pair of transversely spaced stripping belt means.

4. The waste stripper of claim 3 wherein a first of said stripping belt means is fixed in location and the second of said stripping belt means is transversely movable toward and away from the first stripping belt means.

5. The waste stripper of claim 4 wherein the first stripping belt means is positioned adjacent to one lateral side of the frame.

6. The waste stripper of claim 1 wherein the first frictional engagement area is planar in configuration.

7. The waste stripper of claim 6 wherein the first frictional of engagement area is in the planar alignment with the plane of the support means.

8. The waste stripper of claim 1 wherein the third of said belts is in frictional engagement with and is rotatively driven by the first belt through a second frictional engagement area, the edge portions of the waste being engaged in the second frictional engagement area.

9. The waste stripper of claim 8 wherein the second frictional engagement area is circular in configuration.

10. The waste stripper of claim 9 wherein the second frictional engagement area begins in the said plane and extends downwardly therefrom, whereby the waste is urged downwardly away from the plane to positively separate the waste from the usable portion of the blank.

11. The waste stripper of claim 10 and a waste conveyor supported by the frame below the second frictional engagement area, the waste conveyor receiving and transporting the waste after it has been separated from the usable portion of the blank.

12. A stripper for removing automatically the waste from the usable portions of previously die-cut blanks comprising a frame having lateral sides, an input end and a discharge end;

a feed conveyor supported on the frame and being adapted to carry the die-cut blanks from the input end toward the discharge end;

a stripping section supported on the frame near the discharge end and being positioned to receive the die-cut blanks from the feed conveyor, the stripping section comprising support means to support the blank usable portions in a plane, a pair of transversely spaced stripping belt means to engage edge portions of the waste and to carry the engaged edge portions away from the plane, the first of said pair being fixed in location and the second of said pair being adapted to be transversely movable toward and away from the first;

and rack and pinion means to move transversely the second said stripping belt means; and discharge means to receive the blank usable portions from the support means and to discharge the usable portions at the discharge end.

13. The waste stripper of claim 12 wherein at least one of the stripping belt means comprises a driving belt and a pair of first and second driven belts, the driving belt and the first driven belt being in frictional engagement and defining a planar engagement area therebetween, the planar engagement area being positioned in alignment with the said plane and being adapted to engage the edge portions of the waste to transport the waste and the attached usable portion of the blank through the stripping section.

14. The waste stripper of claim 13 wherein the driving belt and the second driven belt are in frictional engagement and define a circular engagement area therebetween, the circular engagement area beginning in the said plane and being adapted to engage portions of the waste to transport the waste away from the said plane.

15. The waste stripper of claim 13 wherein the driving belt rotates about a pair of pulleys and the first driven belt rotates about a pair of pulleys, and wherein one driving belt pulley and one first driven belt pulley are in vertical alignment and define a nip therebetween.

16. The waste stripper of claim 15 wherein the nip is positioned in the said plane.

17. The waste stripper of claim 13 wherein the driving belt rotates about a pair of pulleys and the second driven belt rotates about at least a pair of pulleys, and wherein one driving belt pulley and two driven belt pulleys are in vertical alignment.

18. The waste stripper of claim 17 wherein the second driven belt follows a serpentine path of travel about the vertically aligned pulleys.

* * * * *